US005653099A

United States Patent [19]

MacKenzie

[11] Patent Number: 5,653,099

[45] Date of Patent: Aug. 5, 1997

[54] WALL PANELLING AND FLOOR CONSTRUCTION (BUILDINGS)

[75] Inventor: Robin Kenneth MacKenzie, Edinburgh, Scotland

[73] Assignee: Heriot-Watt University, Edinburgh, United Kingdom

[21] Appl. No.: 535,297

[22] PCT Filed: May 19, 1994

[86] PCT No.: PCT/GB94/01071

§ 371 Date: Feb. 28, 1996

§ 102(e) Date: Feb. 28, 1996

[87] PCT Pub. No.: WO94/27000

PCT Pub. Date: Nov. 24, 1994

[30] Foreign Application Priority Data

May 19, 1993 [GB] United Kingdom ..... 9310312

[51] Int. Cl.[6] ..... E04F 15/22

[52] U.S. Cl. ..... 52/403.1; 52/480

[58] Field of Search ..... 52/403.1, 480, 52/479, 481.1, 508, 309.4, 309.6

[56] References Cited

U.S. PATENT DOCUMENTS

| | | | |
|---|---|---|---|
| 5,103,614 | 4/1992 | Kawaguchi et al. | 52/403.1 |
| 5,253,464 | 10/1993 | Nilsen | 52/480 |
| 5,476,959 | 12/1995 | Mackenzie | 52/403.1 |

*Primary Examiner*—Creighton Smith

*Attorney, Agent, or Firm*—Gifford, Krass, Groh, Sprinkle, Patmore, Anderson & Citkowski, P.C.

[57] ABSTRACT

A floor construction of wood panels (12) overlying a base support (11) with a layer (13) of yieldably resilient materials (14, 15) sandwiched between the panels (12) and the base support (11). The materials (14, 15) are of mutually different stillnesses, one being a relatively large main panel area of an open-cellular material (14) and the other being a relatively small area of a closed-cellular material (15) in the form of strips bordering the main panel area. The open-cellular material (14) provides a large degree of vibration isolation, whilst the closed-cellular (stiffer) material (15) stabilizes the panels in the vicinity of panel-to-panel joints and/or the floor periphery.

7 Claims, 2 Drawing Sheets

WALL PANELLING AND FLOOR CONSTRUCTION (BUILDINGS)

This invention relates to wall panelling and flooring constructions in buildings and is concerned particularly with the attenuation of sound transmitted through such constructions.

British patent specification No. 625520 discloses a resilient flooring construction featuring a surface layer of flexible sheet material laid in sections and having sealed joints. These sections, which are laid over a resilient material, are squares or panels of compressed cork and are mutually inter-engaged by tongue-and-groove joints. A disadvantage of this construction is that the panel joints are prone to failure by shearing because they are no better supported than the inner area of each panel. Such failure, apart from breaking the sealing, impairs the smoothness or regularity of the floor surface.

According to the present invention, there is provided wall panelling or flooring comprising an assembly of panels laid substantially edge-to-edge over a base support having a continuous or effectively continuous supporting surface, and yieldably resilient material sandwiched between the said assembly and the supporting surface substantially co-extensive therewith; characterized in that adjacent each edge portion of each panel and extending in parallel with such edge portion the yieldably resilient material is a relatively high-stiffness material, and the remaining yieldably resilient material comprises mainly a relatively low-stiffness material.

By providing the relatively high-stiffness material adjacent and in parallel with the panel edges, the panel-to-panel joints and the flooring edges are stabilized sufficiently greatly to reduced the aforementioned disadvantage whilst remaining resiliently supported for sound attenuation.

An embodiment of the present invention will now be described, by way of example, with reference to the accompanying drawings in which.

Figure 1:
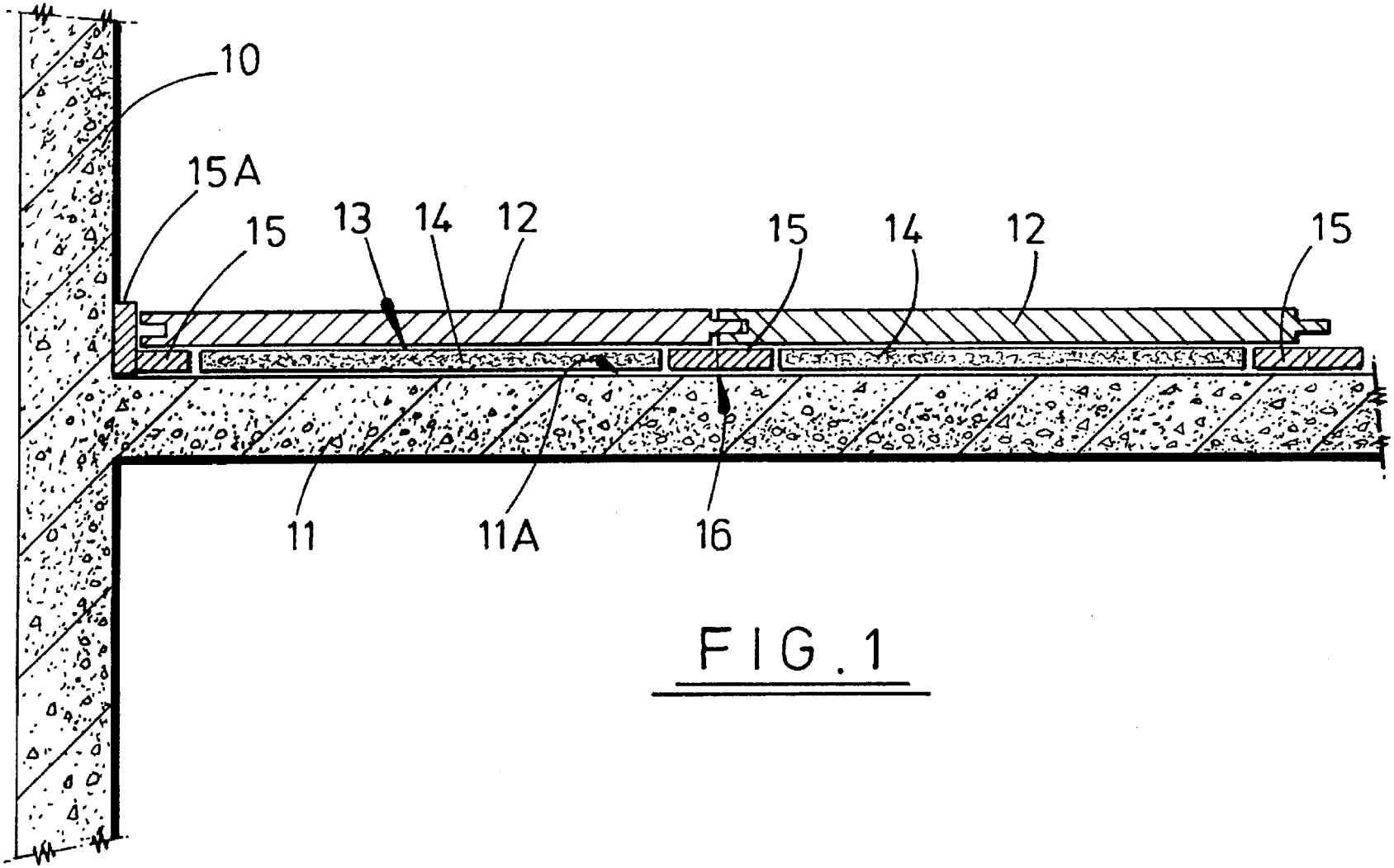
FIG. 1 is a sectional elevation (not to scale) of a flooring construction in accordance with the present invention.

In FIG. 1, part of a building wall and floor are represented by reference numerals 10, 11 respectively. The floor 11 is of concrete construction having a continuous top surface 11A to provide a base support for a floor construction. Rectangular flooring panels 12 are laid over the base floor 11, and sandwiched between the flooring panels 12 and the top surface 11A of the base floor 11 is a layer indicated generally by reference numeral 13 containing mutually adjacent areas of yieldably resilient materials 14, 15 of mutually different stiffnesses.

Figure 2:
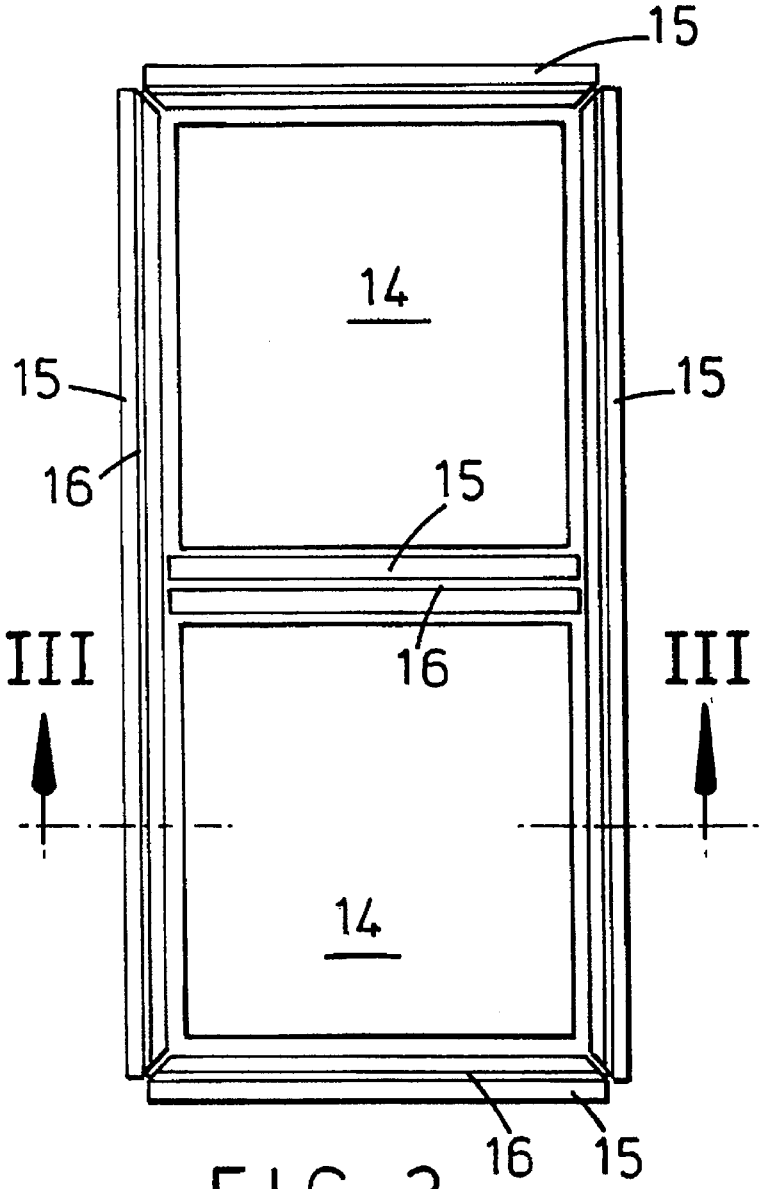
FIG. 2 is a view on the underside of a panel assembly appearing in FIG. 1.
Figure 3:
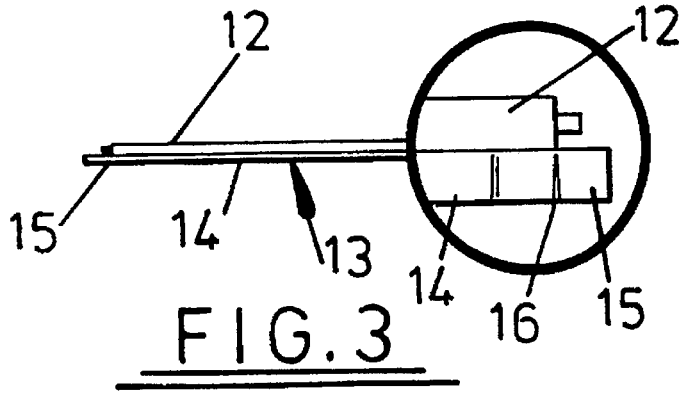
FIG. 3 is a sectional elevation on the line III—III in FIG. 2.

More particularly, each flooring panel 12 consists of a sheet of plywood 1200 mm×600 mm and 9 mm thick, as shown in FIGS. 2 and 3. On one side of each flooring panel 12, a relatively large area is covered by the relatively low stiffness material 14 in two 8 mm thick rectangular sheets as shown in FIG. 2. The relatively high stiffness material is present as 8 mm thick×50 mm wide strips arranged regularly around the low stiffness material. The high stiffness material strips 15 extend beyond the periphery of the panel 12 for the purpose of overlapping an adjacent panel 12 or for the purpose of providing a returned at the strip 15A periphery of the floor construction as shown in FIG. 1 adjacent the wall 10.

To facilitate the returning of peripheral strips 15A, the strips are longitudinally slit as indicated by reference numeral 16.

The relatively low stiffness material is an open-cell polymer foam having a static deflection ("stiffness") of the order of 4 mm under a loading of 8000 pascals; and the relatively high stiffness material is a closed-cell polymer foam having a static deflection or stiffness of the order 1 mm under a loading of 8000 pascals.

The floor construction described above has an advantageously small overall thickness dimension. The 9 mm thick plywood flooring panels 12 are stabilized, particularly at the panel-to-panel joints, by means of the relatively high stiffness material 15 whilst the relatively low stiffness material 14 provides a large degree of vibration isolation. The entire set of flooring panels 12 is supported resiliently.

Modifications of the above described floor construction, within the scope of the claims appended hereto, include the use of a base support of material other than concrete. For example, the base support may be made of wood boards or the like. Also, the supporting surface of the base support need not be fully continuous but should be effectively continuous. A base support comprising perforated or apertured or expanded materials would have an effectively continuous supporting surface in the present context. Also, the strips 15 of relatively high stiffness material need not extend beyond the periphery of each panel 12; and the panels 12 may be of a wide variety of materials including timber, chipboard, hardboard, fiberboard, plastics and metals.

It will be understood that a large variety of patterns may be used for the different areas of the yieldably resilient materials; and the appropriate thicknesses and stiffnesses can be determined readily by simple experiment. Further, it is anticipated that the yieldably resilient materials need not be of cellular characteristic. For example, the relatively high stiffness material may in some applications be solid rubber or the like. It is anticipated that panel assemblies such as described herein may be used in other applications or constructions involving surfaces subject to various loadings. For example, wall constructions or enclosure constructions subject to impact in environments such as games rooms and the like.

I claim:

1. Wall panelling or flooring comprising an assembly of panels (12) laid substantially edge-to-edge over a base support (11) having a continuous or effectively continuous supporting surface (11A), and yieldably resilient material (13) sandwiched between the said assembly and the supporting surface (11A) substantially co-extensive therewith; characterized in that said resilient material comprises a first portion adjacent each edge portion of each panel (12) and extending in parallel with such edge portion, the yieldably resilient material first portion (13) being a relatively high-stiffness material (15), and a second portion of remaining yieldably resilient material comprising mainly a relatively low-stiffness material (14).

2. Wall panelling or flooring according to claim 1; characterized in that the panels (12) are of rectilinear configuration and are mutually inter-engaged.

3. Wall panelling or flooring according to claim 1 characterized in that the relatively high-stiffness material (15) is a cellular material of closed-cell construction.

4. Wall panelling or flooring according to claim 1 characterized in that the relatively low-stiffness material is a cellular material of open-cell construction.

5. Wall panelling or flooring according to claim 1; characterized in that the yieldably resiliently material (13) is sheet material about 8 mm thick.

6. Wall panelling or flooring according to claim 5; characterized in that the relatively high-stiffness material (15) has a static deflection in a range of 1 mm under a loading of 8000 pascals and in that the relatively low-stiffness material (14) has a static deflection of the order of 4 mm under a loading of 8000 pascals.

7. Wall panelling or flooring according to claim 1; characterized in that the yieldably resilient materials (14, 15) are secured to the panels (12).

* * * * *